US007681418B2

(12) United States Patent
Wong et al.

(10) Patent No.: US 7,681,418 B2
(45) Date of Patent: Mar. 23, 2010

(54) WATER SUPPLY CONTROL FOR A STEAM GENERATOR OF A FABRIC TREATMENT APPLIANCE USING A TEMPERATURE SENSOR

(75) Inventors: Nyik Siong Wong, St. Joseph, MI (US); Raveendran Vaidhyanathan, St. Joseph, MI (US); Dengming Peng, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 812 days.

(21) Appl. No.: 11/464,513

(22) Filed: Aug. 15, 2006

(65) Prior Publication Data

US 2008/0040868 A1 Feb. 21, 2008

(51) Int. Cl.
*D06F 33/02* (2006.01)
*D06F 39/00* (2006.01)

(52) U.S. Cl. ..... 68/5 C; 68/12.03; 68/12.22; 68/12.27

(58) Field of Classification Search ..... 68/5 R, 68/5 C, 12.03, 12.21, 12.22, 12.27, 23 R, 68/24, 207; 34/411
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |

(Continued)

FOREIGN PATENT DOCUMENTS

CA 1330526 C 7/1994

(Continued)

OTHER PUBLICATIONS

V-Zug Ltd Washing Machine Adora SL; User Manual; V-Zug Ag, CH-6301 Zug, 2004; V-Zug Ltd Industriestrasse 66, 6301 Zug, Tel. 041 767 67 67.

*Primary Examiner*—Joseph L Perrin
(74) *Attorney, Agent, or Firm*—Clifton G. Green; McGarry Bair, P.C.

(57) ABSTRACT

A fabric treatment appliance comprises a steam generator having a chamber configured to hold water; a supply conduit configured to transport water to the steam generator chamber; a temperature sensor configured to sense a temperature representative of the steam generator chamber at a predetermined water level in the steam generator chamber; and a controller coupled to the temperature sensor and configured to control flow of water through the supply conduit based on the sensed temperature to control the level of water in the steam generator chamber. The disclosure provides methods of water supply control that can employ the temperature sensor.

11 Claims, 7 Drawing Sheets

U.S. PATENT DOCUMENTS

| | | | | |
|---|---|---|---|---|
| 3,035,145 | A | 5/1962 | Rudolph | |
| 3,060,713 | A | 10/1962 | Burkall | |
| 3,223,108 | A | 12/1965 | Martz, Jr. | |
| 3,347,066 | A | 10/1967 | Klausner | |
| 3,712,089 | A | 1/1973 | Toth | 68/210 |
| 3,801,077 | A | 4/1974 | Pearson | |
| 3,869,815 | A | 3/1975 | Bullock | |
| 3,890,987 | A | 6/1975 | Marcussen et al. | |
| 3,935,719 | A | 2/1976 | Henderson | |
| 4,020,396 | A | 4/1977 | Gambale et al. | |
| 4,034,583 | A | 7/1977 | Miessler | 68/16 |
| 4,045,174 | A | 8/1977 | Fuhring et al. | |
| 4,108,000 | A | 8/1978 | Norris | |
| 4,177,928 | A | 12/1979 | Bergkvist | |
| 4,207,683 | A | 6/1980 | Horton | 34/60 |
| 4,214,148 | A | 7/1980 | Fleischauer | |
| 4,332,047 | A | 6/1982 | Kuttelwesch | 8/158 |
| 4,386,509 | A | 6/1983 | Kuttelwesch | 68/20 |
| 4,432,111 | A | 2/1984 | Hoffmann et al. | 8/158 |
| 4,489,574 | A | 12/1984 | Spendel | |
| 4,646,630 | A | 3/1987 | McCoy et al. | |
| 4,761,305 | A | 8/1988 | Ochiai | |
| 4,777,682 | A | 10/1988 | Dreher et al. | 8/158 |
| 4,784,666 | A | 11/1988 | Brenner et al. | 8/137 |
| 4,809,597 | A | 3/1989 | Lin | |
| 4,879,887 | A | 11/1989 | Kagi et al. | 68/16 |
| 4,920,668 | A | 5/1990 | Henneberger et al. | |
| 4,987,627 | A | 1/1991 | Cur et al. | 8/158 |
| 4,991,545 | A | 2/1991 | Rabe et al. | |
| 5,032,186 | A | 7/1991 | Childers et al. | 134/25 |
| 5,050,259 | A | 9/1991 | Tsubaki et al. | 8/159 |
| 5,052,344 | A | 10/1991 | Kosugi et al. | |
| 5,058,194 | A | 10/1991 | Violi | |
| 5,063,609 | A | 11/1991 | Lorimer | |
| 5,107,606 | A | 4/1992 | Tsubaki et al. | 34/133 |
| 5,146,693 | A | 9/1992 | Dottor et al. | 34/77 |
| 5,152,252 | A | 10/1992 | Bolton et al. | |
| 5,172,654 | A | 12/1992 | Christiansen | |
| 5,212,969 | A | 5/1993 | Tsubaki et al. | 68/19.2 |
| 5,219,370 | A | 6/1993 | Farrington et al. | |
| 5,219,371 | A | 6/1993 | Shim et al. | 8/149 |
| 5,279,676 | A | 1/1994 | Oslin et al. | |
| 5,291,758 | A | 3/1994 | Lee | 68/196 |
| 5,293,761 | A | 3/1994 | Jang | 68/15 |
| 5,315,727 | A | 5/1994 | Lee | 8/159 |
| 5,345,637 | A | 9/1994 | Pastryk et al. | 8/158 |
| 5,570,626 | A | 11/1996 | Vos | |
| 5,619,983 | A | 4/1997 | Smith | |
| 5,727,402 | A | 3/1998 | Wada | |
| 5,732,664 | A | 3/1998 | Badeaux, Jr. | |
| 5,743,034 | A | 4/1998 | Debourg et al. | |
| 5,758,377 | A | 6/1998 | Cimetta et al. | |
| 5,768,730 | A | 6/1998 | Matsumoto et al. | |
| 5,815,637 | A | 9/1998 | Allen et al. | |
| 6,029,300 | A | 2/2000 | Kawaguchi et al. | |
| 6,067,403 | A | 5/2000 | Morgandi | 392/401 |
| 6,094,523 | A | 7/2000 | Zelina et al. | |
| 6,122,849 | A | 9/2000 | Kida et al. | |
| 6,161,306 | A | 12/2000 | Clodic | 34/321 |
| 6,178,671 | B1 | 1/2001 | Zwanenburg et al. | |
| 6,295,691 | B1 | 10/2001 | Chen | |
| 6,434,857 | B1 | 8/2002 | Anderson et al. | |
| 6,451,066 | B2 | 9/2002 | Estes et al. | |
| 6,585,781 | B1 | 7/2003 | Roseen | 8/149.1 |
| 6,622,529 | B1 | 9/2003 | Crane | |
| 6,647,931 | B1 | 11/2003 | Morgandi et al. | |
| 6,691,536 | B2 | 2/2004 | Severns et al. | |
| 6,772,751 | B2 | 8/2004 | Deuringer et al. | |
| 6,789,404 | B2 | 9/2004 | Kim et al. | |
| 6,874,191 | B2 | 4/2005 | Kim et al. | |
| 6,889,399 | B2 | 5/2005 | Steiner et al. | 8/159 |
| 7,021,087 | B2 | 4/2006 | France et al. | |
| 7,096,828 | B2 | 8/2006 | Tippmann | |
| 7,290,412 | B2 * | 11/2007 | Yang et al. | 68/5 C |
| 7,325,330 | B2 * | 2/2008 | Kim et al. | 34/407 |
| 7,404,304 | B2 * | 7/2008 | Yang et al. | 68/5 C |
| 7,421,752 | B2 | 9/2008 | Donadon et al. | |
| 7,490,491 | B2 * | 2/2009 | Yang et al. | 68/12.05 |
| 7,490,493 | B2 * | 2/2009 | Kim et al. | 68/15 |
| 7,520,146 | B2 * | 4/2009 | Kim et al. | 68/15 |
| 2001/0032599 | A1 | 10/2001 | Fischer et al. | |
| 2003/0215226 | A1 | 11/2003 | Nomura et al. | |
| 2004/0163184 | A1 * | 8/2004 | Waldron et al. | 8/149.1 |
| 2004/0187527 | A1 | 9/2004 | Kim et al. | 68/5 |
| 2004/0187529 | A1 | 9/2004 | Kim et al. | 68/207 |
| 2004/0200093 | A1 | 10/2004 | Wunderlin et al. | |
| 2004/0206480 | A1 | 10/2004 | Maydanik et al. | |
| 2004/0237603 | A1 | 12/2004 | Kim et al. | |
| 2004/0244432 | A1 | 12/2004 | Kim et al. | 68/5 |
| 2004/0244438 | A1 | 12/2004 | North | 68/23.2 |
| 2004/0255391 | A1 | 12/2004 | Kim et al. | 8/149 |
| 2005/0028297 | A1 | 2/2005 | Kim et al. | |
| 2005/0034248 | A1 | 2/2005 | Oh et al. | 8/149 |
| 2005/0034249 | A1 | 2/2005 | Oh et al. | 8/159 |
| 2005/0034250 | A1 | 2/2005 | Oh et al. | 8/159 |
| 2005/0034487 | A1 | 2/2005 | Oh et al. | 68/5 |
| 2005/0034488 | A1 | 2/2005 | Oh et al. | 68/5 |
| 2005/0034489 | A1 | 2/2005 | Oh et al. | 68/5 |
| 2005/0034490 | A1 | 2/2005 | Oh et al. | 68/5 |
| 2005/0050644 | A1 | 3/2005 | Severns et al. | |
| 2005/0072382 | A1 | 4/2005 | Tippmann, Sr. | |
| 2005/0072383 | A1 | 4/2005 | Powell et al. | |
| 2005/0092035 | A1 | 5/2005 | Shin et al. | 68/275 |
| 2005/0132503 | A1 | 6/2005 | Yang et al. | 8/149 |
| 2005/0132504 | A1 | 6/2005 | Yang et al. | 8/159 |
| 2005/0132756 | A1 | 6/2005 | Yang et al. | 68/12.15 |
| 2005/0144734 | A1 | 7/2005 | Yang et al. | 8/149.3 |
| 2005/0144735 | A1 | 7/2005 | Yang et al. | 8/149.3 |
| 2005/0144737 | A1 | 7/2005 | Roepke et al. | |
| 2005/0220672 | A1 | 10/2005 | Takahashi et al. | |
| 2005/0223503 | A1 | 10/2005 | Hong et al. | 8/158 |
| 2005/0223504 | A1 | 10/2005 | Lee et al. | |
| 2005/0252250 | A1 | 11/2005 | Oh et al. | |
| 2005/0262644 | A1 | 12/2005 | Oak et al. | |
| 2006/0000242 | A1 | 1/2006 | Yang et al. | |
| 2006/0001612 | A1 | 1/2006 | Kim | |
| 2006/0005581 | A1 | 1/2006 | Banba | |
| 2006/0010613 | A1 | 1/2006 | Jeon et al. | |
| 2006/0010727 | A1 | 1/2006 | Fung | |
| 2006/0010937 | A1 | 1/2006 | Kim et al. | |
| 2006/0016020 | A1 | 1/2006 | Park | |
| 2006/0090524 | A1 | 5/2006 | Jeon et al. | |
| 2006/0096333 | A1 | 5/2006 | Park et al. | |
| 2006/0101586 | A1 | 5/2006 | Park et al. | |
| 2006/0101588 | A1 | 5/2006 | Park et al. | |
| 2006/0101867 | A1 | 5/2006 | Kleker | |
| 2006/0107468 | A1 | 5/2006 | Urbanet et al. | |
| 2006/0112585 | A1 | 6/2006 | Choi et al. | |
| 2006/0117596 | A1 | 6/2006 | Kim et al. | |
| 2006/0130354 | A1 | 6/2006 | Choi et al. | |
| 2006/0137105 | A1 | 6/2006 | Hong et al. | |
| 2006/0137107 | A1 | 6/2006 | Lee et al. | |
| 2006/0150689 | A1 | 7/2006 | Kim et al. | |
| 2006/0151005 | A1 | 7/2006 | Kim et al. | |
| 2006/0151009 | A1 | 7/2006 | Kim et al. | |
| 2006/0191077 | A1 | 8/2006 | Oh et al. | |
| 2006/0191078 | A1 | 8/2006 | Kim et al. | |
| 2006/0277690 | A1 | 12/2006 | Pyo et al. | |
| 2007/0006484 | A1 | 1/2007 | Moschuetz et al. | |
| 2007/0028398 | A1 | 2/2007 | Kwon et al. | |
| 2007/0101773 | A1 | 5/2007 | Park et al. | |
| 2007/0107472 | A1 | 5/2007 | Kim et al. | |
| 2007/0107884 | A1 | 5/2007 | Sirkar et al. | |
| 2007/0125133 | A1 | 6/2007 | Oh et al. | |

| | | | |
|---|---|---|---|
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 06123360 | | 5/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | A2 | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1507033 | A1 | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555339 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |
| FR | 2581442 | A2 | 11/1986 |
| FR | 2688807 | A1 | 9/1993 |

| | | | |
|---|---|---|---|
| GB | 21286 | | 8/1898 |
| GB | 10423 | | 11/1909 |
| GB | 21024 | | 2/1910 |
| GB | 191010567 | A | 4/1911 |
| GB | 191010792 | A | 4/1911 |
| GB | 191022943 | A | 8/1911 |
| GB | 191024005 | A | 10/1911 |
| GB | 191103554 | A | 12/1911 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 102466 | A1 | 9/1993 |
| GB | 2309071 | A | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | A | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 08261689 | | 10/1996 |
| JP | 9133305 | A | 5/1997 |
| JP | 11047488 | A | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 200311068 | | 11/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| JP | 2004167131 | | 9/2007 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | A | 4/2006 |
| WO | 9214954 | | 9/1992 |
| WO | 9307798 | A1 | 4/1993 |
| WO | 9319237 | A1 | 9/1993 |
| WO | 97/15709 | | 5/1997 |
| WO | 98/03175 | | 1/1998 |
| WO | 01/11134 | | 2/2001 |
| WO | 0174129 | A2 | 10/2001 |
| WO | 2001074129 | A2 | 10/2001 |
| WO | 03/012185 | | 2/2003 |
| WO | 03012185 | A2 | 2/2003 |
| WO | 03057966 | | 7/2003 |
| WO | 2004/059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101336 | A1 | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006101377 | A1 | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |

| | | | |
|---|---|---|---|
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

* cited by examiner

WATER SUPPLY CONTROL FOR A STEAM GENERATOR OF A FABRIC TREATMENT APPLIANCE USING A TEMPERATURE SENSOR

BACKGROUND OF THE INVENTION

1. Field of the Invention

The invention relates to methods and structures for controlling supply of water to a steam generator of a fabric treatment appliance.

2. Description of the Related Art

Some fabric treatment appliances, such as a washing machine, a clothes dryer, and a fabric refreshing or revitalizing machine, utilize steam generators for various reasons. The steam from the steam generator can be used to, for example, heat water, heat a load of fabric items and any water absorbed by the fabric items, dewrinkle fabric items, remove odors from fabric items, etc.

Typically, the steam generator receives water from a household water supply. It is important that the steam generator has a sufficient amount of water to achieve a desired steam generation rate and to prevent damage to the steam generator. Prior art fabric appliances incorporate pressure sensors and electrical conduction sensors in the steam generator to determine the level of water in the steam generator. Based on the output of the sensor, water can be supplied to the steam generator to maintain a desired water level. While these pressure and electrical conduction sensors provide a couple ways of controlling the supply of water to the steam generator, other possibly more economical, reliable, and elegant methods and structures for controlling the water supply to a steam generator of a fabric treatment appliance are desirable.

SUMMARY OF THE INVENTION

A fabric treatment appliance according to one embodiment of the invention comprises at least one of a tub and drum defining a fabric treatment chamber; a steam generator configured to supply steam to the fabric treatment chamber and comprising a chamber configured to hold water; a supply conduit configured to transport water to the steam generator chamber; a temperature sensor configured to sense a temperature representative of the steam generator chamber at a predetermined water level in the steam generator chamber; and a controller coupled to the temperature sensor and configured to control flow of water through the supply conduit based on the sensed temperature to control the level of water in the steam generator chamber.

The fabric treatment appliance can further comprise a valve fluidly coupled to the supply conduit to control the flow of water through the supply conduit. The controller can be coupled to the valve to control operation of the valve based on the sensed temperature.

The temperature sensor can be located on the steam generator at a position corresponding to the predetermined water level.

The temperature sensor can sense a temperature of the steam generator chamber.

The steam generator can further comprise a housing that defines the chamber, and the temperature sensor can sense a temperature of the housing.

The predetermined water level can be a minimum water level in the chamber.

The steam generator can be an in-line steam generator. The steam generator can comprise an outlet portion, and the predetermined water level can be located at the outlet portion. The steam generator outlet portion can comprise an ascending conduit.

A method according to one embodiment of the invention of operating a fabric treatment appliance comprising a fabric treatment chamber and a steam generator for supplying steam to the fabric treatment chamber and having a housing defining a chamber configured to hold water comprises determining a temperature representative of the steam generator chamber corresponding to a predetermined water level in the steam generator chamber; supplying water to the steam generator based on the determined temperature; and generating steam in the steam generator from the supplied water.

The determining of the temperature can comprise determining the temperature of the steam generation chamber at the predetermined water level. The determining of the temperature can comprise determining the temperature of the steam generator housing. The determining of the temperature can comprise determining the temperature of the steam generator chamber.

The determining of the temperature can comprise sensing the temperature.

The supplying of the water can comprise supplying water to achieve at least the predetermined water level.

The determining of the temperature can comprise determining a temperature at an outlet of the chamber.

The supplying of the water can comprise supplying the water when the determined temperature is greater than or equal to a predetermined temperature. The method can further comprise stopping the supply of water when the determined temperature decreases to a temperature less than or equal to the predetermined temperature.

The supplying of the water can comprise supplying the water when the determined temperature increases by an amount greater than or equal to a predetermined temperature increase.

DESCRIPTION OF EMBODIMENTS OF THE INVENTION

The invention provides methods and structures for controlling a supply of water to a steam generator of a fabric treatment appliance. The fabric treatment appliance can be any machine that treats fabrics, and examples of the fabric treatment appliance include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing machine; an extractor; a non-aqueous washing apparatus; and a revitalizing machine. For illustrative purposes, the invention will be described with respect to a washing machine, with it being understood that the invention can be adapted for use with any type of fabric treatment appliance having a steam generator.

Figure 1:
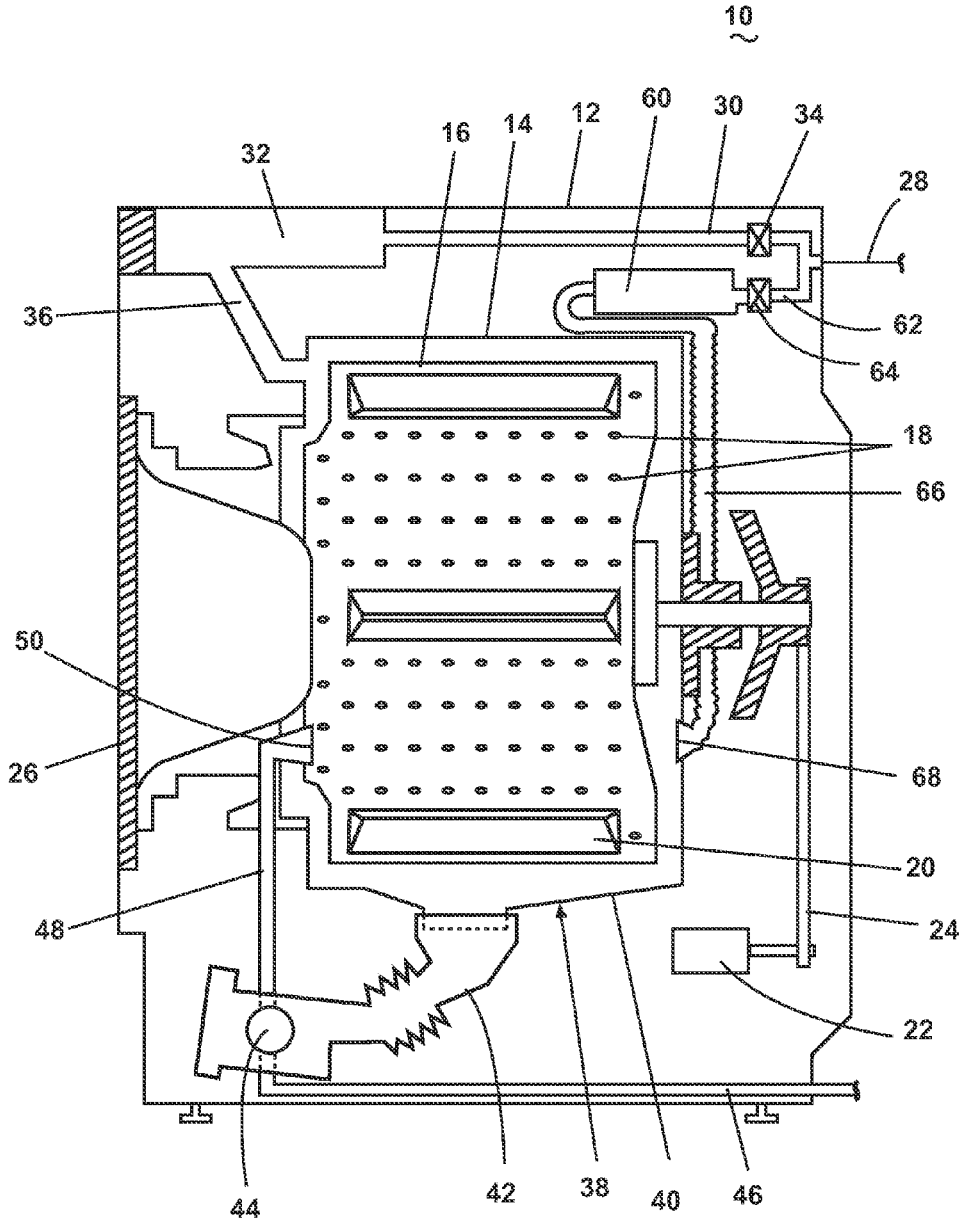
FIG. 1 is a schematic view of a steam washing machine comprising a steam generator according to one embodiment of the invention.

Referring now to the figures, FIG. 1 is a schematic view of an exemplary steam washing machine 10. The washing machine 10 comprises a cabinet 12 that houses a stationary tub 14. A rotatable drum 16 mounted within the tub 14 defines a fabric treatment chamber and includes a plurality of perforations 18, and liquid can flow between the tub 14 and the drum 16 through the perforations 18. The drum 16 further comprises a plurality of baffles 20 disposed on an inner surface of the drum 16 to lift fabric items contained in the drum 16 while the drum 16 rotates, as is well known in the washing machine art. A motor 22 coupled to the drum 16 through a belt 24 rotates the drum 16. Both the tub 14 and the drum 16 can be selectively closed by a door 26.

Washing machines are typically categorized as either a vertical axis washing machine or a horizontal axis washing machine. As used herein, the "vertical axis" washing machine refers to a washing machine comprising a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum can rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis. Vertical axis and horizontal axis machines are best differentiated by the manner in which they impart mechanical energy to the fabric articles. The illustrated exemplary washing machine of FIG. 1 is a horizontal axis washing machine.

The motor 22 can rotate the drum 16 at various speeds in opposite rotational directions. In particular, the motor 22 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the baffles 20. Alternatively, the motor 22 can rotate the drum 16 at spin speeds wherein the fabric items rotate with the drum 16 without falling.

The washing machine 10 of FIG. 1 further comprises a liquid supply and recirculation system. Liquid, such as water, can be supplied to the washing machine 10 from a household water supply 28. A first supply conduit 30 fluidly couples the water supply 28 to a detergent dispenser 32. An inlet valve 34 controls flow of the liquid from the water supply 28 and through the first supply conduit 30 to the detergent dispenser 32. The inlet valve 34 can be positioned in any suitable location between the water supply 28 and the detergent dispenser 32. A liquid conduit 36 fluidly couples the detergent dispenser 32 with the tub 14. The liquid conduit 36 can couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 enters a space between the tub 14 and the drum 16 and flows by gravity to a sump 38 formed in part by a lower portion 40 of the tub 14. The sump 38 is also formed by a sump conduit 42 that fluidly couples the lower portion 40 of the tub 14 to a pump 44. The pump 44 can direct fluid to a drain conduit 46, which drains the liquid from the washing machine 10, or to a recirculation conduit 48, which terminates at a recirculation inlet 50. The recirculation inlet 50 directs the liquid from the recirculation conduit 48 into the drum 16. The recirculation inlet 50 can introduce the liquid into the drum 16 in any suitable manner, such as by spraying, dripping, or providing a steady flow of the liquid.

The exemplary washing machine 10 further includes a steam generation system. The steam generation system comprises a steam generator 60 that receives liquid from the water supply 28 through a second supply conduit 62. A flow controller 64 controls flow of the liquid from the water supply 28 and through the second supply conduit 62 to the steam generator 60. The flow controller 64 can be positioned in any suitable location between the water supply 28 and the steam generator 60. A steam conduit 66 fluidly couples the steam generator 60 to a steam inlet 68, which introduces steam into the tub 14. The steam inlet 68 can couple with the tub 14 at any suitable location on the tub 14 and is shown as being coupled to a rear wall of the tub 14 in FIG. 1 for exemplary purposes. According to one embodiment of the invention, the steam inlet 68 is positioned at a height higher than a level corresponding to a maximum level of the liquid in the tub 14 to prevent backflow of the liquid into the steam conduit 66. The steam that enters the tub 14 through the steam inlet 68 subsequently enters the drum 16 through the perforations 18. Alternatively, the steam inlet 68 can be configured to introduce the steam directly into the drum 16. The steam inlet 68 can introduce the steam into the tub 14 in any suitable manner. The washing machine 10 can further include an exhaust conduit that directs steam that leaves the tub 14 externally of the washing machine 10. The exhaust conduit can be configured to exhaust the steam directly to the exterior of the washing machine 10. Alternatively, the exhaust conduit can be configured to direct the steam through a condenser prior to leaving the washing machine 10.

The steam generator 60 can be any type of device that converts the liquid to steam. For example, the steam generator 60 can be a tank-type steam generator that stores a volume of liquid and heats the volume of liquid to convert the liquid to steam. Alternatively, the steam generator 60 can be an in-line steam generator that converts the liquid to steam as the liquid flows through the steam generator 60. The steam generator 60 can produce pressurized or non-pressurized steam.

In addition to producing steam, the steam generator 60, whether an in-line steam generator, a tank-type steam generator, or any other type of steam generator, can heat water to a temperature below a steam transformation temperature, whereby the steam generator 60 produces hot water. The hot water can be delivered to the tub 14 and/or drum 16 from the steam generator 60. The hot water can be used alone or can optionally mix with cold water in the tub 14 and/or drum 16. Using the steam generator to produce hot water can be useful when the steam generator 60 couples only with a cold water source of the water supply 28.

Figure 2:
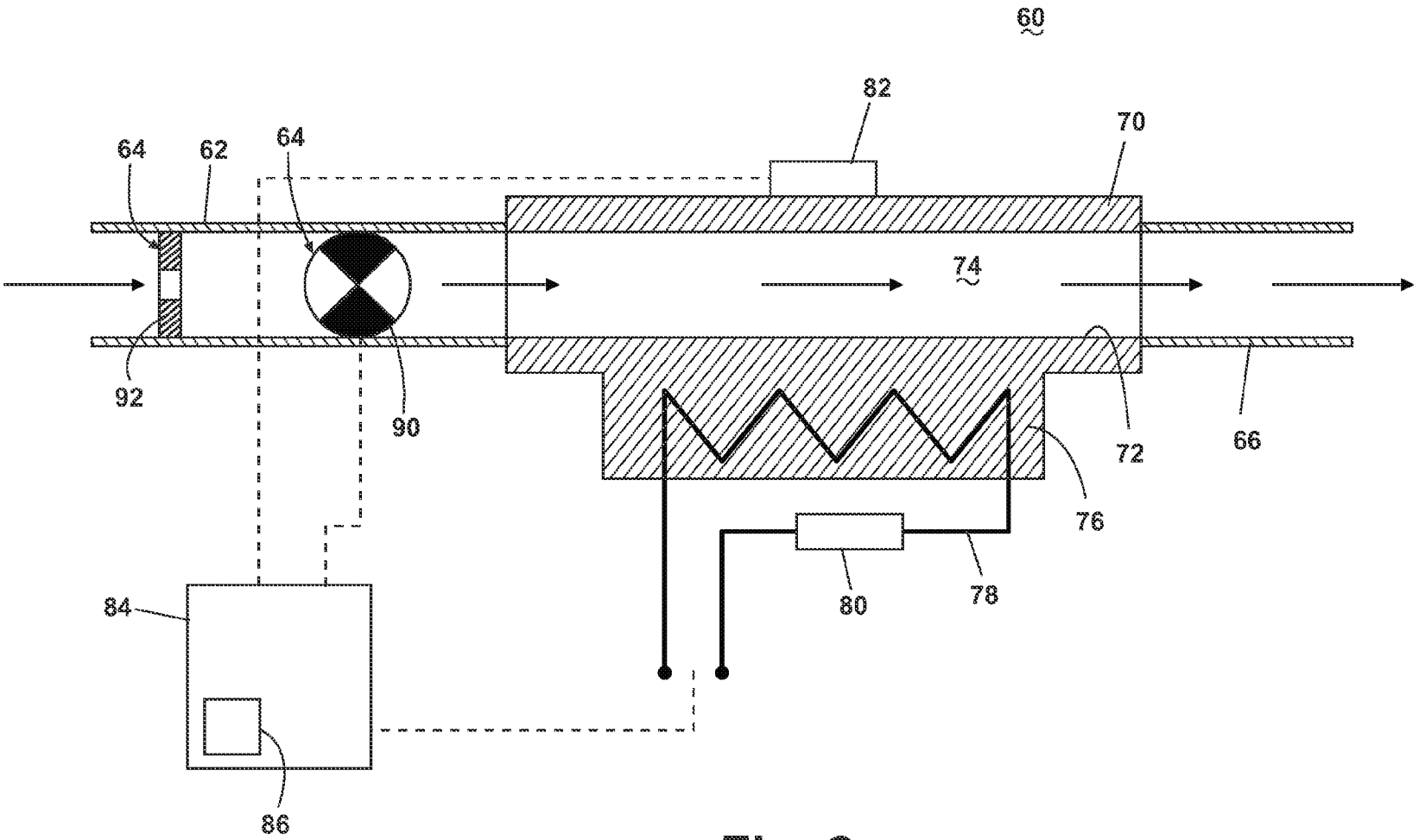
FIG. 2 is a schematic view of a first embodiment steam generator for use with the washing machine of FIG. 1.

FIG. 2 is a schematic view of an exemplary in-line steam generator 60 for use with the washing machine 10. The steam generator 60 comprises a housing or main body 70 in the form of a generally cylindrical tube. The main body 70 has an inside surface 72 that defines a steam generation chamber 74. The steam generation chamber 74 is fluidly coupled to the second supply conduit 62 such that fluid from the second supply conduit 62 can flow through the flow controller 64 and can enter the steam generation chamber 74. The steam generation chamber 74 is also fluidly coupled to the steam conduit 66 such that steam generated in the steam generation chamber 74 can flow into the steam conduit 66. The flow of fluid into and steam out of the steam generation chamber 74 is represented by arrows in FIG. 2.

The flow controller 64 effects a flow of water through the second supply conduit 62 and also restricts a flow rate of the water through the second supply conduit 62. The pressure and, therefore, flow rate of water associated with the water supply 28 can vary depending on geography (i.e., the pressure can vary from country to country and within a country, such as from municipality to municipality within the United States). To accommodate this variation in pressure and provide a relatively constant flow rate, the flow controller 64 restricts the flow rate through the second supply conduit 62 to a restricted flow rate that is less than the flow rate of the water supply 28.

The flow controller 64 can take on many forms, and one example of the flow controller 64 comprises a valve 90 and a restrictor 92. The valve 90 can be any suitable type of valve that can open to allow water to flow through the second supply conduit 62 to the steam generation chamber 74 and close to prevent water from flowing through the second supply conduit 62 to the steam generation chamber 74. For example, the valve 90 can be a solenoid valve having an "on" or open position and an "off" or closed position. The restrictor 92 can be any suitable type of restrictor that restricts the flow rate of water through the second supply conduit 62. For example, the restrictor 92 can be a rubber flow restrictor, such as a rubber disc-like member, located within the second supply conduit 62.

Both the valve 90 and the restrictor 92 have a corresponding flow rate. According to one embodiment and as illustrated in FIG. 2, the restrictor 92 can have a restrictor flow rate that is greater than a valve flow rate, which is the flow rate of the valve 90. With such relative flow rates, the restrictor 92 can be located upstream from the valve 90 whereby the restrictor 92 restricts the flow rate of the water supply 28 to provide a relatively constant flow rate, and the valve 90 further restricts the flow rate and simultaneously controls the flow of water through the second supply conduit 62.

According to another embodiment, the restrictor flow rate can be less than the valve flow rate, and the restrictor 92 can be located downstream from the valve 90. For this configuration, the valve 90 can open to allow the water to flow through the valve 90 at the valve flow rate, and the restrictor 92 reduces the flow rate of the water from the valve flow rate to the restrictor flow rate.

According to yet another embodiment, the valve 90 and the restrictor 92 can be integrated into a single unit whereby the valve 90 and the restrictor effectively simultaneously effect water flow through the second supply conduit 62 and restrict the flow rate through the second supply conduit 62 to a flow rate less than that associated with the water supply 28.

Regardless of the relative configuration of the valve 90 and the restrictor 92, the valve 90 can be configured to supply the fluid to the steam generator 60 in any suitable manner. For example, the fluid can be supplied in a continuous manner or according to a duty cycle where the fluid is supplied for discrete periods of time when the valve 90 is open separated by discrete periods of time when the valve 90 is closed. Thus, for the duty cycle, the periods of time when the fluid can flow through the valve 90 alternate with the periods of time when the fluid cannot flow through the valve 90.

Alternatively, the flow controller 64 can comprise a proportional valve that performs the functions of both the valve 90 and the restrictor 92, i.e., the controlling the flow of water and controlling the rate of the flow through the second supply conduit 62. In this way, the proportion valve can provide a continuous supply of water at the desired flow rate, without the need for cycling the valve in accordance with a duty cycle. The proportional valve can be any suitable type of proportional valve, such as a solenoid proportional valve.

The steam generator 60 further comprises a heater body 76 and a heater 78 embedded in the heater body 76. The heater body 76 is made of a material capable of conducting heat. For example, the heater body 76 can be made of a metal, such as aluminum. The heater body 76 of the illustrated embodiment is shown as being integrally formed with the main body 70, but it is within the scope of the invention for the heater body 76 to be formed as a component separate from the main body 70. In the illustrated embodiment, the main body 70 can also be made of a heat conductive material, such as metal. As a result, heat generated by the heater 78 can conduct through the heater body 76 and the main body 70 to heat fluid in the steam generation chamber 74. The heater 78 can be any suitable type of heater, such as a resistive heater, configured to generate heat. A thermal fuse 80 can be positioned in series with the heater 78 to prevent overheating of the heater 78. Alternatively, the heater 78 can be located within the steam generation chamber 74 or in any other suitable location in the steam generator 60.

The steam generator 60 further includes a temperature sensor 82 that can sense a temperature of the steam generation chamber 74 or a temperature representative of the temperature of the steam generation chamber 74. The temperature sensor 82 of the illustrated embodiment is coupled to the main body 70; however, it is within the scope of the invention to employ temperature sensors in other locations. For example, the temperature sensor 82 can be a probe-type sensor that extends through the inside surface 72 into the steam generation chamber 74.

The temperature sensor 82 and the heater 78 can be coupled to a controller 84, which can control the operation of heater 78 in response to information received from the temperature sensor 82. The controller 84 can also be coupled to the flow controller 64, such as to the valve 90 of the flow controller 64 of the illustrated embodiment, to control the operation of the flow controller 64 and can include a timer 86 to measure a time during which the flow controller 64 effects the flow of water through the second supply conduit 62.

The washing machine 10 can further comprise a controller coupled to various working components of the washing machine 10, such as the pump 44, the motor 22, the inlet valve 34, the flow controller 64, the detergent dispenser 32, and the steam generator 60, to control the operation of the washing machine 10. The controller can receive data from the working components and can provide commands, which can be based on the received data, to the working components to execute a desired operation of the washing machine 10.

The liquid supply and recirculation system and the steam generator system can differ from the configuration shown in FIG. 1, such as by inclusion of other valves, conduits, wash aid dispensers, and the like, to control the flow of liquid and steam through the washing machine 10 and for the introduction of more than one type of detergent/wash aid. For example, a valve can be located in the liquid conduit 36, in the recirculation conduit 48, and in the steam conduit 66. Furthermore, an additional conduit can be included to couple the water supply 28 directly to the tub 14 or the drum 16 so that the liquid provided to the tub 14 or the drum 16 does not have to pass through the detergent dispenser 32. Alternatively, the liquid can be provided to the tub 14 or the drum 16 through the steam generator 60 rather than through the detergent dispenser 32 or the additional conduit. As another example, the recirculation conduit 48 can be coupled to the liquid conduit 36 so that the recirculated liquid enters the tub 14 or the drum 16 at the same location where the liquid from the detergent dispenser 32 enters the tub 14.

The washing machine of FIG. 1 is provided for exemplary purposes only. It is within the scope of the invention to perform the inventive methods described below or use the steam generator 60 on other types of washing machines, examples of which are disclosed in: Ser. No. 11/450,636, titled "Method of Operating a Washing Machine Using Steam;" our, Ser. No. 11/450,529, titled "Steam Washing Machine Operation Method Having Dual Speed Spin Pre-Wash;" and our, Ser. No. 11/450,620, titled "Steam Washing Machine Operation Method Having Dry Spin Pre-Wash," all filed Jun. 9, 2006, which are incorporated herein by reference in their entirety.

Figure 3:
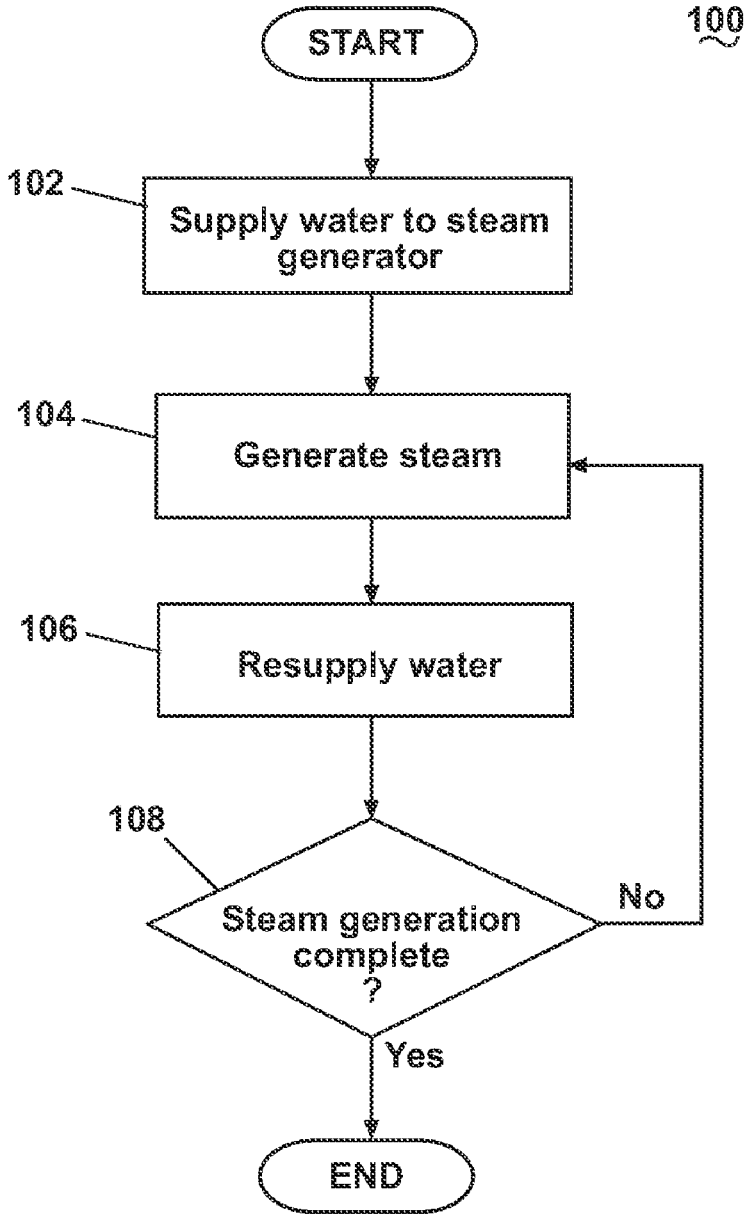
FIG. 3 is a flow chart of a method of operating the steam washing machine of FIG. 1 according to one embodiment of the invention to control a supply of water to the steam generator.

A method 100 of operating the washing machine 10 to control the supply of water to the steam generator 60 according to one embodiment of the invention is illustrated in the flow chart of FIG. 3. In general, the method 100 comprises a step 102 of supplying water to the steam generator 60 followed by a step 104 of generating steam from the supplied water. Either during or after the generation of steam in the step 104, water can be resupplied to the steam generator 60 in a step 106 to replenish the water in the steam generator 60 that has converted to steam. In step 108, it is determined if the steam generation is complete, which can be determined in any suitable manner. For example, the steam generation can occur for a predetermined period of time or until a fabric load in the fabric treatment chamber achieves a predetermined temperature. If the steam generation is not complete, then the steps 104, 106 of generating the steam and resupplying the water to the steam generator 60 are repeated until it is determined that the steam generation is complete. The steps 104, 106, 108 can be performed sequentially or simultaneously.

The method 100 can be executed in the following manner when using the steam generator 60 having the flow controller 64. Because the flow rate of the flow controller 64 is known, the flow controller 64 can supply a first known volume of water during the step 102 of supplying water to the steam generator 60 by operating for a first predetermined time. In other words, the first predetermined time for operating the flow controller 64 (units=time) can be calculated by multiplying the first known volume of water (units=volume) by the inverse of the flow rate of the flow controller 64 (units=time/volume). When calculating the first predetermined time, the flow rate of the controller 64 equals the smaller of the valve flow rate and the restrictor flow rate (assuming the flow controller 64 comprises both the valve 90 and the restrictor 92) as the smaller flow rate determines the flow rate of the water that enters the steam generation chamber 74. Once the first predetermined time is determined, the controller 84 opens the valve 90 for the first predetermined time, which can be measured by the timer 86, to supply the first known volume of water.

In practice, the controller of the washing machine 10 might not actually execute the above calculation of the first predetermined time. Rather, the controller can be programmed with data sets relating volume and time for one or more flow rates, and the controller can refer to the data sets instead of performing calculations during the operation of the washing machine 10.

The first known volume of water can be any suitable volume. In an initial supply of water to the steam generator 60, for example, the first known volume of water can correspond to the volume of the steam generation chamber 74 to completely fill the steam generation chamber 74 with water.

The steam generator 60 converts the supplied water to steam and thereby consumes the water in the steam generation chamber 74. Knowing a rate of steam generation during the steam generation step 104 enables a determination of the volume of water converted to steam and thereby removed from the steam generation chamber 74. The resupplying of the water in the step 106 can comprise supplying a second known volume of water to increase the water level in the steam generation chamber 74 and replace the water that has converted to steam and exited the steam generation chamber 74. The second known volume of water can be supplied during the step 106 of resupplying the water for a second predetermined time, which can be calculated in a manner similar to that described above with respect to the first predetermined time. Once the second predetermined time is determined, the controller 84 opens the valve 90 for the second predetermined time, which can be measured by the timer 86, to supply the second known volume of water.

Optionally, the resupplying of the water can maintain the first known volume of water supplied to the steam generator 60. Alternatively, the resupplying of the water can increase the water level in the steam generation chamber 74 above that achieved with the first predetermined known of water or maintain a water level the steam generation chamber 74 below that achieved with the first known volume of water. When the second known volume of water is less than the first known volume of water, the second predetermined time is logically less than the first predetermined time as the flow rate through the second supply conduit 62 remains constant. The resupplying of the water can occur at discrete intervals, such as after certain time periods of steam generation, or continuously during the generation of steam.

Figure 4:
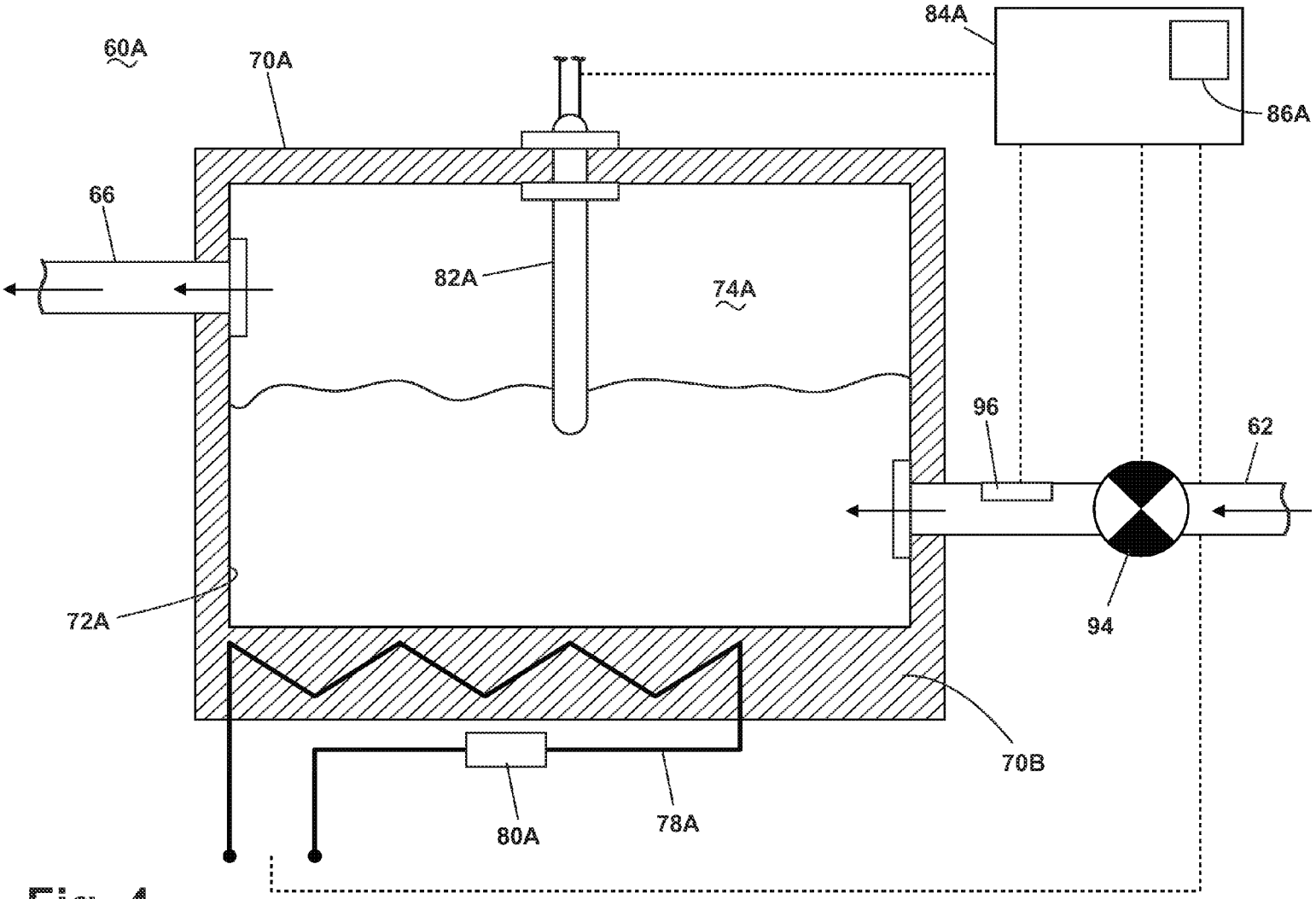
FIG. 4 is a schematic view of a second embodiment steam generator for use with the washing machine of FIG. 1.

An alternative steam generator 60A is illustrated in FIG. 4, where components similar to those of the first embodiment steam generator 60 are identified with the same reference numeral bearing the letter "A." The steam generator 60A is a tank-type steam generator comprising a housing or main body 70A in the form of a generally rectangular tank. The main body 70A has an inside surface 72A that defines a steam generation chamber 74A. The steam generation chamber 74A is fluidly coupled to the second supply conduit 62 such that fluid from the water supply 28 can flow through a valve 94 in the second supply conduit 62 and can enter the steam generation chamber 74A, as indicated by the solid arrows entering the steam generation chamber 74A in FIG. 4. The steam generation chamber 74A is also fluidly coupled to the steam conduit 66 such that steam from the steam generation chamber 74A can flow through the steam conduit 66 to the drum 16, as depicted by solid arrows leaving the steam generation chamber 74A in FIG. 4.

A flow meter 96 located in the second supply conduit 62 determines a flow of water through the second supply conduit 62 and into the steam generation chamber 74A. The flow meter 96 can have any suitable output representative of the flow of water through the second supply conduit 62. For example, the output of the flow meter 96 can be a flow rate of the water through the second supply conduit 62 or a volume of water supplied through the second supply conduit 62.

The steam generator 60A further comprises a heater 78A, which is shown as being embedded in the main body 70A. It is within the scope of the invention, however, to locate the heater 78A within the steam generation chamber 74A or in any other suitable location in the steam generator 60A. When the heater 78A is embedded in the main body 70A, the main body 70A is made of a material capable of conducting heat. For example, the main body 70A can be made of a metal, such as aluminum. As a result, heat generated by the heater 78A can conduct through the main body 70A to heat fluid in the steam generation chamber 74A. The heater 78A can be any suitable type of heater, such as a resistive heater, configured to generate heat. A thermal fuse 80A can be positioned in series with the heater 78A to prevent overheating of the heater 78A.

The steam generator 60A further includes a temperature sensor 82A that can sense a temperature of the steam generation chamber 74A or a temperature representative of the temperature of the steam generation chamber 74A. The temperature sensor 82A of the illustrated embodiment is a probe-type sensor that projects into the steam generation chamber 74A; however, it is within the scope of the invention to employ temperature sensors in other locations.

The temperature sensor 82A and the heater 78A can be coupled to a controller 84A, which can control the operation of heater 78A in response to information received from the temperature sensor 82A. The controller 84A can also be coupled to the valve 94 and the flow meter 96 to control the operation of the valve 94 and can include a timer 86A to measure a time during which the valve 94 effects the flow of water through the second supply conduit 62.

The method 100 of operating the washing machine 10 illustrated in the flow chart of FIG. 3 can also be executed with the second embodiment steam generator 60A of FIG. 4. The execution of the method 100 differs from the exemplary execution described above with respect to the first embodiment steam generator 60 due to the use of the flow meter 96 in the second embodiment steam generator 60A rather than the flow controller 64.

The method 100 can be executed in the following manner when using the steam generator 60A having the flow meter 96. For the step 102 of supplying the water to the steam generator 60A, output from the flow meter 96 can be used to determine a volume of water supplied to the steam generation chamber 74A while the water is being supplied through the second supply conduit 62.

For example, in one embodiment, the flow meter 96 can sense the flow rate of the water through the second supply conduit 62 (units=volume/time), and the flow rate can be multiplied by the time the water has been supplied as determined by the timer 86A (units=time) to calculate the volume of water supplied (units=volume). In practice, the controller of the washing machine 10 might not actually execute the above calculation of the volume of water supplied. Rather, the controller can be programmed with data sets relating time and volume for one or more flow rates, and the controller can refer to the data sets instead of performing calculations during the operation of the washing machine 10. Alternatively, the flow meter 96 can directly output the volume of water supplied, thereby negating the need to calculate the volume.

The output from the flow meter 96 can be used to supply a first predetermined volume of water to the steam generator 60A in the step 102, whereby the controller 84A opens the valve 94 to begin the supply of the first predetermined volume of water and closes the valve 94 when the output from the flow meter 96 communicates that the first predetermined volume of water has been supplied.

The first predetermined volume of water can be any suitable volume. In an initial supply of water to the steam generator 60A, for example, the first predetermined volume of water can correspond to the volume of the steam generation chamber 74A to completely fill the steam generation chamber 74A with water.

The steam generator 60A converts the supplied water to steam and thereby consumes the water in the steam generation chamber 74A. Knowing a rate of steam generation during the steam generation step 104 enables a determination of the volume of water converted to steam and thereby removed from the steam generation chamber 74A. The resupplying of the water in the step 106 can comprise supplying a second predetermined volume of water to increase the water level in the steam generation chamber 74A and replace the water that has converted to steam and exited the steam generation chamber 74A. The second predetermined volume of water can be supplied during the step 106 of resupplying the water in the manner described above for supplying the first predetermined volume of water. In particular, the controller 84A opens the valve 94 to begin the supply of the second predetermined volume of water, the output of the flow meter 96 can be used to determine the volume of water supplied through the second supply conduit 62 as the water is being supplied, and the controller 84A closes the valve 94 to stop the supply when the second predetermined volume of water has been supplied.

Optionally, the resupplying of the water can maintain the first predetermined volume of water supplied to the steam generator 60A. Alternatively, the resupplying of the water can increase the water level in the steam generation chamber 74A above that achieved with the first predetermined volume of water or maintain a water level the steam generation chamber 74A below that achieved with the first predetermined volume of water. The resupplying of the water can occur at discrete intervals, such as after certain time periods of steam generation, or continuously during the generation of steam.

While the flow controller 64 has been described with respect to an in-line steam generator, and the flow meter 96 has been described with respect to a tank-type steam generator, it is within the scope of the invention to utilize any type of steam generator with the flow controller 64 and any type of steam generator with the flow meter 96. For example, the flow controller 64 can be used on a tank-type steam generator, and the flow meter 96 can be employed with an in-line steam generator. Further, any type of steam generator can be utilized for executing the method 100. The execution of the method 100 is not intended to be limited for use only with steam generators comprising the flow controller 64 and the flow meter 96.

Figure 5:
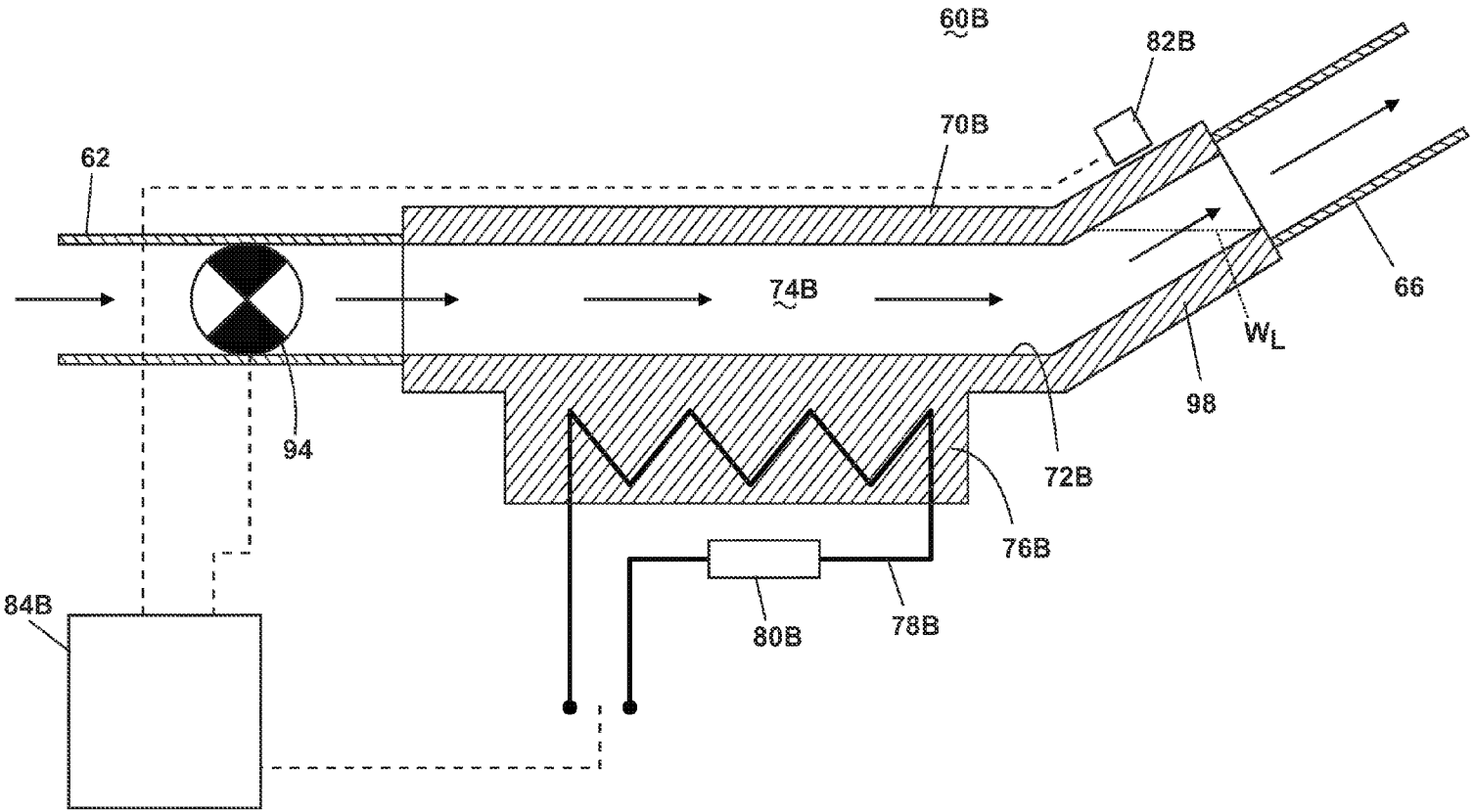
FIG. 5 is a schematic view of a third embodiment steam generator for use with the washing machine of FIG. 1.

An alternative steam generator 60B is illustrated in FIG. 5, where components similar to those of the first and second embodiment steam generators 60, 60A are identified with the same reference numeral bearing the letter "B." The steam generator 60B is substantially identical to the first embodiment steam generator 60, except the fluid flow through the second supply conduit 62 is controlled by a valve 94, the main body 70B includes an ascending outlet portion 98, and the temperature sensor 82B is positioned to detect a temperature representative of the steam generation chamber 74B at a predetermined water level in the steam generation chamber 74B, which in the illustrated embodiment is at the ascending outlet portion 98. The controller 84B is coupled to the temperature sensor 82B, the heater 78B, and the valve 94 to control operation of the steam generator 60B.

The ascending outlet portion 98 is illustrated as being integral with the main body 70B; however, it is within the scope of the invention for the ascending outlet portion 98 to be a separate component or conduit that fluidly couples the main body 70B to the steam conduit 66. Regardless of the configuration of the ascending outlet portion 98, the interior of the ascending outlet portion 98 forms a portion of the steam generation chamber 74B. In other words, the steam generation chamber 74B extends into the ascending outlet portion 98. FIG. 5 illustrates the predetermined water level as a dotted line WL located in the ascending outlet portion 98. The predetermined water level can be a minimum water level in the steam generation chamber 74 or any other water level, including a range of water levels.

The temperature sensor 82B can detect the temperature representative of the steam generation chamber 74B in any suitable manner. For example, the temperature sensor 82B can detect the temperature by directly sensing a temperature of the main body 70B or other structural housing that forms the ascending outlet portion 98. Directly sensing the temperature of the main body 70B can be accomplished by locating or mounting the temperature sensor 82B on the main body 70B, as shown in the illustrated embodiment. Alternatively, the temperature sensor 82B can detect the temperature by directly sensing a temperature of the steam generation chamber 74B, such as by being located inside or at least projecting partially into the steam generation chamber 74B. Furthermore, it is within the scope of the invention to locate the temperature sensor 82B at the location corresponding to the predetermined water level or at another location where the temperature sensor 82B is capable of detecting the temperature representative of the steam generation chamber 74B at the predetermined water level.

In general, during operation of the steam generator 60B, the temperature sensor 82B detects the temperature representative of the steam generation chamber 74B at the predetermined water level in the steam generation chamber 74B and sends an output to the controller 84B. The controller 84B controls the valve 94 to supply water to the steam generator based on the output from the temperature sensor 82B.

The operation of the steam generator 60B with respect to the temperature sensor 82B illustrated in FIG. 5 will be described with an initial assumption that water has been supplied to the steam generation chamber 74B via the second supply conduit 62 and the valve 94 to at least the predetermined water level. Once the water has been supplied to at least the predetermined water level and the heater 78B is powered to heat the water to a steam generation temperature, the temperature sensor 82B detects a relatively stable temperature as long as the water level in the steam generation chamber 74B remains near the predetermined level. The output of the temperature sensor 82B will inherently have some fluctuation, and the determination of whether the output is relatively stable can be made, for example, by determining if the fluctuation of the output is within a predetermined amount of acceptable fluctuation.

As the water converts to steam and the water level in the steam generation chamber 74B drops below the predetermined water level, the temperature sensor 82B detects a relatively sharp increase in temperature. The sharp increase in temperature results from the absence of water in the steam generation chamber 74B at the predetermined water level. The controller 84B can recognize the sensed temperature increase as a relatively unstable output of the temperature sensor 82B. As stated above, the output of the temperature sensor 82B will inherently have some fluctuation, and the determination of whether the output is relatively unstable can be made, for example, by determining if the fluctuation of the output exceeds the predetermined amount of acceptable fluctuation. In response to the increase in the temperature, the controller 84B opens the valve 94 to supply water to the steam generation chamber 74B. It is within the scope of the invention for the water level to exceed the predetermined water level when the water is supplied into the steam generation chamber 74B, especially when the predetermined water level corresponds to the minimum water level. The controller 84B closes the valve 94 to stop the supplying of the water when the output of the temperature sensor 82B is relatively stable, thereby indicating that the water level has achieved or exceeded the predetermined water level. The detection of the temperature and the supplying of the water can occur at discrete intervals or continuously during the generation of steam.

The controller 84B can open and close the valve 94 based on any suitable logic in addition to the stable output method just described. For example, the controller 84B can compare the sensed temperature to a predetermined temperature, whereby the controller 84B opens the valve 94 when the sensed temperature is greater than the predetermined temperature and stops the supplying of water by closing the valve 94 when the sensed temperature returns to or becomes less than the predetermined temperature. In this example, the predetermined temperature can alternatively comprise an upper predetermined temperature above which the valve 94 opens and a lower predetermined temperature below which the valve 94 closes. Utilizing the upper and lower predetermined temperatures provides a range that can account for natural fluctuation in the output of the temperature sensor 82B. Alternatively, when the temperature increases, the controller 84B can compare the sensed temperature increase to a predetermined temperature increase and determine that the water has dropped below the predetermined level when the sensed temperature increase exceeds the predetermined temperature increase.

While the use of the temperature sensor 82B to control the supplying of water to the steam generation chamber 74B has been described with respect to an in-line steam generator, it is within the scope of the invention to utilize any type of steam generator, including a tank-type steam generator, with the temperature sensor 82B and the corresponding method of controlling the supply of water with the temperature sensor 82B.

Figure 6:
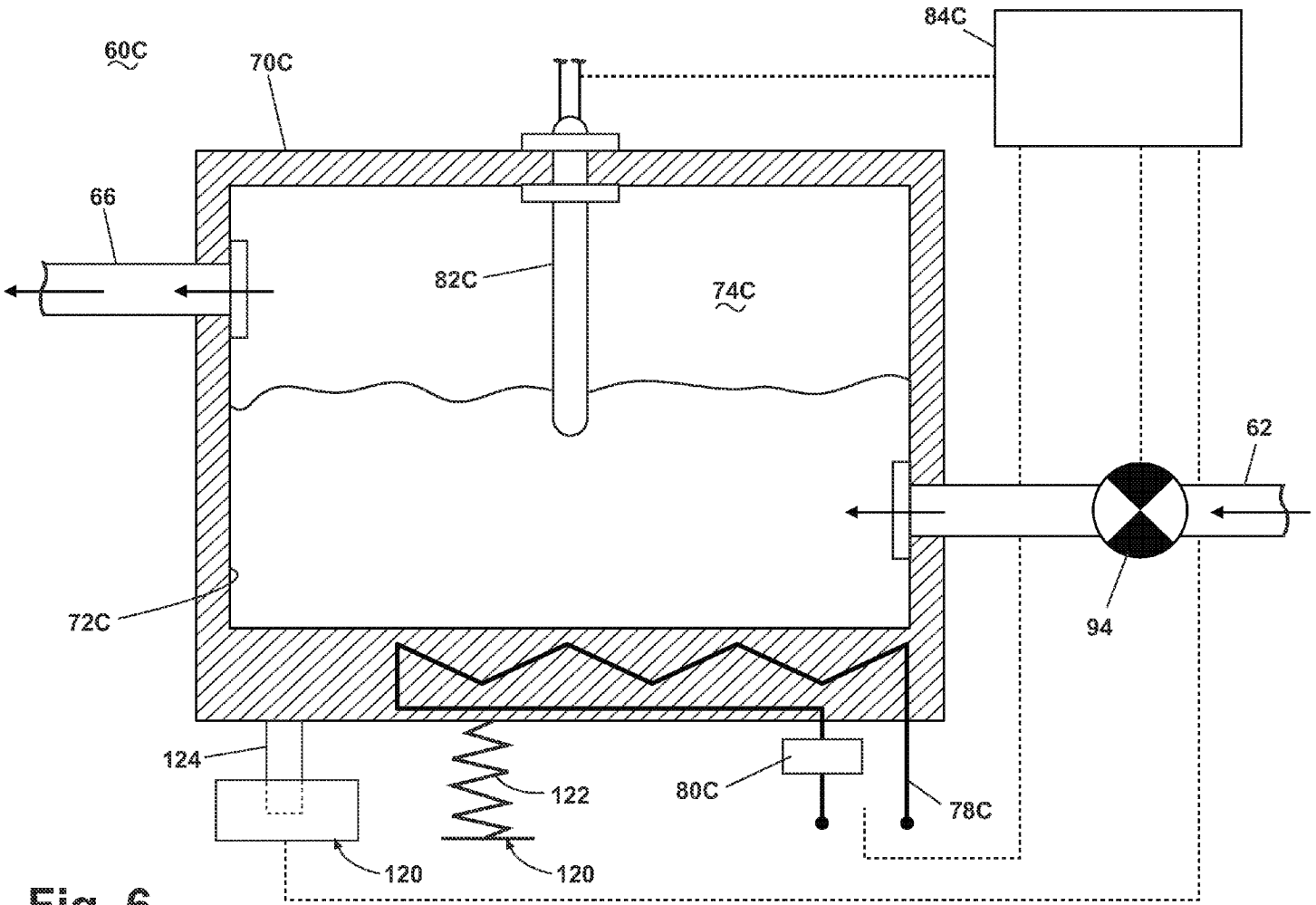
FIG. 6 is a schematic view of a fourth embodiment steam generator for use with the washing machine of FIG. 1, wherein the steam generator comprises a weight sensor shown in a condition corresponding to a steam generator weight greater than a predetermined weight.

An alternative steam generator 60C is illustrated in FIG. 6, where components similar to those of the first, second, and third embodiment steam generators 60, 60A, 60B are identified with the same reference numeral bearing the letter "C." The steam generator 60C is substantially identical to the second embodiment steam generator 60A, except that the former lacks the flow meter 96 and includes a weight sensor 120 that outputs a signal responsive to the weight of the steam generator 60. The controller 84C is coupled to the weight sensor 120, the heater 78C, and the valve 94 to control operation of the steam generator 60C.

The weight sensor 120 of the illustrated embodiment comprises a biasing member 122 and a switch 124. The biasing member 122 can be any suitable device that supports at least a portion of the weight of the steam generator 60C and exerts an upward force on the steam generator 60C. In the exemplary embodiment of FIG. 6, the biasing member 122 comprises a coil compression spring. The switch 124 can be any suitable switching device and actuates or changes state when the weight of the steam generator 60C decreases to below a predetermined weight. Because the supply of water into and evaporation of water from the steam generation chamber 74B alters the weight of the steam generator 60C, the weight of the steam generator 60C directly corresponds to the amount of water in the steam generation chamber 74B. Thus, the predetermined weight corresponds to a predetermined amount of water in the steam generation chamber 74C. The switch 124 is illustrated as being located below the steam generator 60C, but it is within the scope of the invention for the switch 124 to be located in any suitable position relative to the steam generator 60C.

In general, during the operation of the steam generator 60C, the weight sensor 120 outputs a signal representative of the weight of the steam generator 60C, and the controller 84C utilizes the output to determine a status of the water in the steam generator 60C. For example, the status of the water can be whether the amount of water in the steam generator is sufficient (e.g., whether the water at least reaches a predetermined water level). Based on the determined status, the controller 84C controls the supply of the water to the steam generator 60C.

The operation of the steam generator 60C with respect to the weight sensor 120 illustrated in FIG. 6 will be described with an initial assumption that water has been supplied to the steam generation chamber 74C via the second supply conduit 62 and the valve 94 to a level corresponding to an amount of water in the steam generation chamber 74C greater than or equal to a predetermined amount of water. It follows that the amount of water greater than the predetermined amount of water corresponds to a weight of the steam generator greater than a predetermined weight of the steam generator 60C. As shown in FIG. 6, when the amount of water/weight of the steam generator 60C is greater than the predetermined amount of water/predetermined weight of the steam generator 60C, the weight of the steam generator 60C overcomes the upward force applied by the biasing member 122 and depresses the switch 124, as shown in phantom in FIG. 6. The depression of the switch 124 communicates to the controller 84C that the weight of the steam generator is greater than or equal to predetermined weight (i.e., the water level in the steam generation chamber 74C is sufficient), and the controller 84C closes the valve 94 to prevent supply of water to the steam generation chamber 74C.

Figure 7:
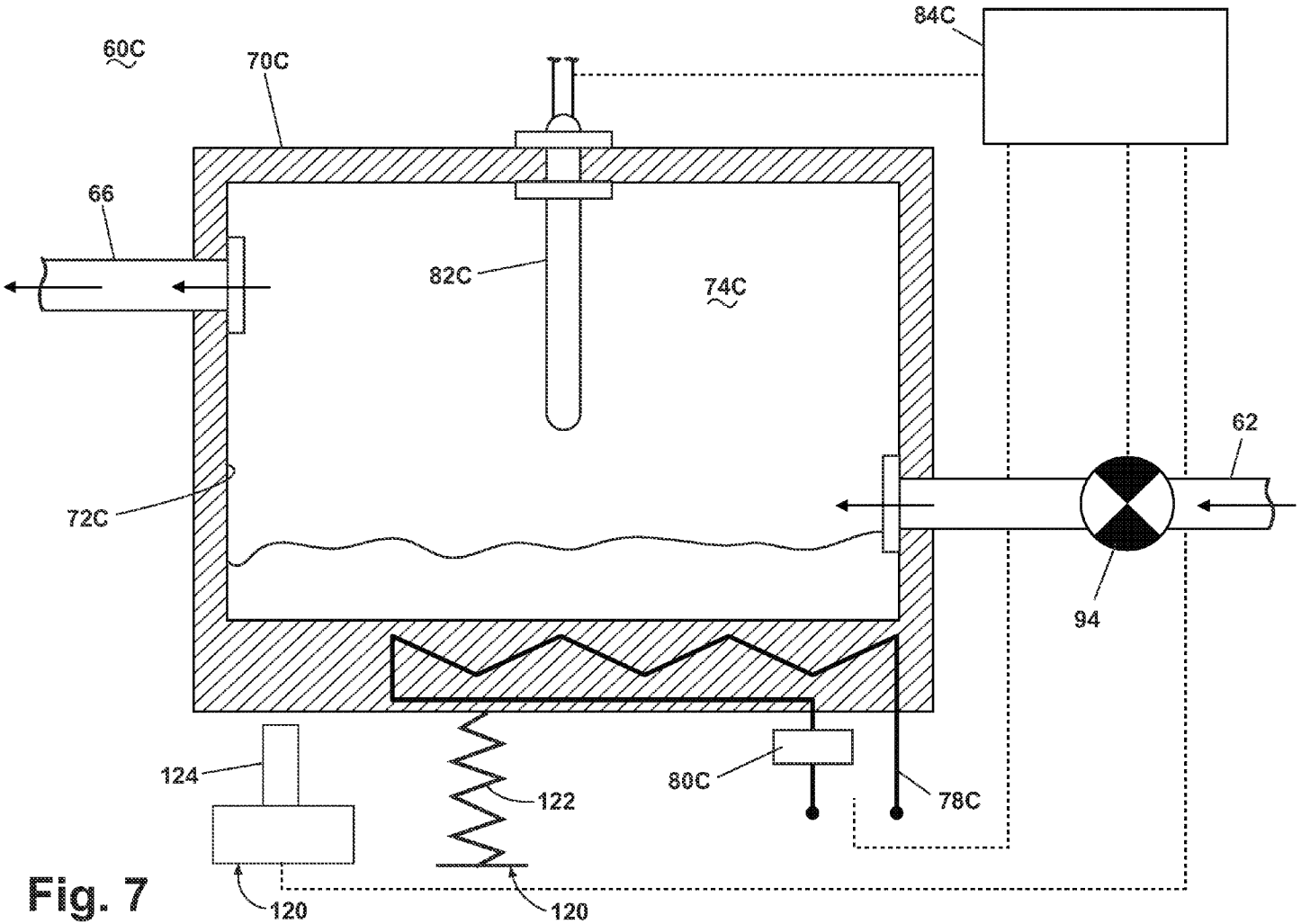
FIG. 7 is a schematic view of the steam generator of FIG. 6 with the weight sensor shown in a condition corresponding to a steam generator weight less than a predetermined weight.

As the heater 78C heats the water in the steam generation chamber 74B, the water converts to steam and leaves the steam generation chamber 74B through the steam conduit 66, as illustrated by arrows in FIG. 6. Consequently, the amount of water in the steam generation chamber 74B decreases. Referring now to FIG. 7, when the amount of water decreases to below the predetermined amount of water, the weight of the steam generator 60C is no longer sufficient to overcome the upward force of the biasing member 122, and biasing member 122 lifts the steam generator 60C from the switch 124, which thereby actuates or changes state to communicate to the controller 84C that the weight of the steam generator 60C is less than the predetermined weight (i.e., the water level in the steam generation chamber 74C is not sufficient). In response, the controller 84B opens the valve 94 to supply water to the steam generation chamber 74B via the second supply conduit 62, as indicated by arrows entering the steam generation chamber 74B in FIG. 7. The controller 84B can close the valve 94 to stop the supply of water when the amount of water/weight of the steam generator 60C reaches or exceeds the predetermined amount of water/predetermined weight of the steam generator 60C, as indicated by depression of the switch 124.

The predetermined amount of water/predetermined weight of the steam generator 60C can be any suitable amount/weight, such as a minimum amount/weight. Further, the predetermined amount/weight can be a single value or can comprise a range of values. The determining of the status of the water and the supplying of the water can occur at discrete intervals or continuously during the generation of steam.

As stated above, the switch 124 can be located in any suitable position relative to the steam generator 60C. For example, the switch 124 can be located above the steam generator 60C whereby the switch depresses when the weight of the steam generator 60C falls below the predetermined weight or on a side of the steam generator 60C, which can include a projection that actuates or changes a state of the switch 124 as the steam generator 60C moves vertically due to a change in weight. The switch 124 can comprise any type of mechanical switch, such as that described above with respect to FIGS. 6 and 7, or can comprise any other type of switch, such as one that includes an infrared sensor that detects the relative positioning of the steam generator 60C to determine the relative weight of the steam generator 60C.

As an alternative to the weight sensor 120 comprising the biasing member 120 and the switch 124, the weight sensor can be any suitable device capable of generating a signal responsive to the weight of the steam generator 60C. For example, the weight sensor can be a scale that measures the weight of the steam generator 60C. The controller 84C can be configured to open the valve 94 to supply a predetermined volume of water corresponding to the measured weight of the steam generator 60C. In other words, the predetermined volume of water can be proportional to the measured weight of the steam generator 60C.

While the use of the weight sensor 120 to control the supplying of water to the steam generation chamber 74C has been described with respect to a tank-type steam generator, it is within the scope of the invention to utilize any type of steam generator, including an in-line steam generator, with the weight sensor 120 and the corresponding method of controlling the supply of water with the weight sensor 120.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fabric treatment appliance comprising:

at least one of a tub and drum defining a fabric treatment chamber;

a steam generator configured to supply steam to the fabric treatment chamber and comprising a chamber configured to hold water;

a supply conduit configured to transport water to the steam generator chamber;

a temperature sensor configured to sense a temperature representative of the steam generator chamber at a predetermined water level in the steam generator chamber; and a controller coupled to the temperature sensor and controlling the flow of water through the supply conduit in response to the sensed temperature to maintain the level of water at the predetermined water level within the steam generator chamber.

2. The fabric treatment appliance of claim 1, further comprising a valve fluidly coupled to the supply conduit to control the flow of water through the supply conduit.

3. The fabric treatment appliance of claim 2 wherein the controller is coupled to the valve to control operation of the valve based on the sensed temperature.

4. The fabric treatment appliance of claim 1 wherein the temperature sensor is located on the steam generator at a position corresponding to the predetermined water level.

5. The fabric treatment appliance of claim 1 wherein the temperature sensor senses a temperature of the steam generator chamber.

6. The fabric treatment appliance of claim 1 wherein the steam generator further comprises a housing that defines the chamber, and the temperature sensor senses a temperature of the housing.

7. The fabric treatment appliance of claim 1 wherein the predetermined water level is a minimum water level in the chamber.

8. The fabric treatment appliance of claim 1 wherein the steam generator is an in-line steam generator.

9. The fabric treatment appliance of claim 8 wherein the steam generator comprises an outlet portion, and the predetermined water level is located at the outlet portion.

10. The fabric treatment appliance of claim 9 wherein the steam generator outlet portion comprises an ascending conduit.

11. A fabric treatment appliance comprising:

at least one of a tub and drum defining a fabric treatment chamber;

a steam generator configured to supply steam to the fabric treatment chamber and comprising a chamber configured to hold water;

a supply conduit configured to transport water to the steam generator chamber;

a temperature sensor located on the exterior of the steam generator to sense a temperature representative of a temperature at a predetermined water level within the steam generator chamber; and a controller coupled to the temperature sensor and controlling the flow of water through the supply conduit in response to the sensed temperature to maintain the level of water at the predetermined water level within the steam generator chamber.

* * * * *